US007699140B2

(12) United States Patent
Beggrow et al.

(10) Patent No.: US 7,699,140 B2
(45) Date of Patent: Apr. 20, 2010

(54) METHOD AND SYSTEM FOR TRANSPORTING A PERSON BETWEEN A PLURALITY OF FIXED PLATFORMS

(76) Inventors: Denny Beggrow, #1 Silverton Star, Durango, CO (US) 81301; John Roy Beggrow, #Silverton Star, Durango, CO (US) 81301

( * ) Notice: Subject to any disclaimer, the term of this patent is extended or adjusted under 35 U.S.C. 154(b) by 1170 days.

(21) Appl. No.: 11/035,670

(22) Filed: Jan. 14, 2005

(65) Prior Publication Data

US 2006/0157298 A1 Jul. 20, 2006

(51) Int. Cl.
*E04G 3/28* (2006.01)

(52) U.S. Cl. ..... 182/36; 182/10

(58) Field of Classification Search ..... 182/10, 182/11, 36; 104/113, 173.6
See application file for complete search history.

(56) References Cited

U.S. PATENT DOCUMENTS

| | | | | | |
|---|---|---|---|---|---|
| 71,922 | A * | 12/1867 | Towse | 104/113 |
| 318,627 | A * | 5/1885 | Keller | 104/113 |
| 900,713 | A * | 10/1908 | Dye | 104/113 |
| 2,547,935 | A * | 4/1951 | Grabinski | 105/155 |
| 3,040,678 | A | 6/1962 | McEwen | 105/150 |
| 3,218,988 | A * | 11/1965 | Gaston et al. | 104/191 |
| 3,861,318 | A * | 1/1975 | Massa | 104/113 |
| 4,062,293 | A | 12/1977 | Davis | 104/113 |
| 4,934,277 | A * | 6/1990 | Smith et al. | 104/113 |
| 5,103,738 | A | 4/1992 | Claussen | 104/204 |
| 5,224,425 | A | 7/1993 | Remington | 104/53 |
| 5,522,186 | A | 6/1996 | Jarman | 52/73 |
| 5,853,331 | A | 12/1998 | Ishikawa et al. | 472/88 |
| 5,904,099 | A | 5/1999 | Danneker | 104/53 |
| 5,979,333 | A | 11/1999 | Houben et al. | 104/63 |
| 6,360,669 | B1 * | 3/2002 | Albrich | 104/93 |
| 6,363,858 | B1 * | 4/2002 | Voirin | 104/173.1 |
| 6,550,392 | B2 | 4/2003 | Albrich | 104/89 |
| 6,622,634 | B2 * | 9/2003 | Cylvick | 104/53 |
| 6,666,773 | B1 | 12/2003 | Richardson | 472/49 |
| 6,886,471 | B2 * | 5/2005 | Rodnunsky | 104/173.2 |
| 2002/0162477 | A1 * | 11/2002 | Palumbo | 104/87 |
| 2006/0027134 | A1 * | 2/2006 | Steele et al. | 104/113 |

FOREIGN PATENT DOCUMENTS

CA 2472784 A1 * 1/2006

OTHER PUBLICATIONS

Printout from www.extextoys.com regarding Zip Lines & Swings for Active Kids (pp. 1-4).

* cited by examiner

*Primary Examiner*—Alvin C Chin-Shue
(74) *Attorney, Agent, or Firm*—Sheridan Ross P.C.

(57) ABSTRACT

A method and device to facilitate the transporting of a person between a plurality of fixed platforms provides a revenue generating activity for owners of nature directed resorts. In one embodiment, a first platform is proportionately higher than a second platform and is connected by a dynamic cable system that allows for cable height adjustments to address environmental and mechanical variables. The method and device provides for an individual to traverse a distance between a plurality of fixed, elevated platforms, while moving along a suspended cable at desired velocities and body positions.

8 Claims, 4 Drawing Sheets

METHOD AND SYSTEM FOR TRANSPORTING A PERSON BETWEEN A PLURALITY OF FIXED PLATFORMS

FIELD OF INVENTION

The present invention is directed to a method and device for transporting at least one person between a plurality of fixed platforms connected by a cable. The present invention is directed generally to a transport system for individuals along a suspended cable, and more particularly to a system and method employing a plurality of tree supported platforms that are linked by suspended cables having predetermined and/or adjustable cable heights.

BACKGROUND OF THE INVENTION

Various transport systems involving the use of trolley/pulley systems along a suspended cable are known in the art. For example, Richardson, U.S. Pat. No. 6,666,773 is directed to a downhill zip line thrill ride system. Davis, U.S. Pat. No. 4,062,293 is directed to a trolley ride apparatus. Remington, U.S. Pat. No. 5,224,425 is directed to a cable skydiving ride. Cylvick, U.S. Pat. No. 6,622,634 is directed to an amusement ride employing a suspended tension static cable.

Some of such prior art systems rely upon the rider to maintain their descent speeds by use of, for example, gloves, complicated braking systems, etc. None of the prior art systems, however, are designed to facilitate retrofitting of existing nature preserve-type properties. Nor are such systems designed to achieve the necessary safety features as employed by the present invention. Moreover, many of the prior art systems are designed to transport a person between two artificial structures, rather than between a plurality of specifically designed platforms, preferably associated with living trees. The prior art systems employed to transport individuals along a suspended cable are more complicated, less safe, and/or more confining than those employed in the present invention.

With the recent appeal of extreme sporting activities, new methods and devices allowing for the safe entertainment of people has been widely sought. Although traditional outdoor pastimes such as hiking, scenic walking, and rock-climbing remain popular with outdoor enthusiasts, there has been an increasing demand for out-door activities that permit all age groups to enjoy a thrilling experience while at the same time allowing them to appreciate a novel perspective to the out-of-doors.

SUMMARY OF THE INVENTION

The present invention is directed generally a method and system for transporting a person between more than two fixed platforms in a fashion that delivers the person predictably and repeatedly, in a safe manner, to an arrival platform without such person having to exert themselves to propel them to such platform or without such person having to reduce their speed and/or to bring themselves to a halt.

In one embodiment, the present invention uses a dynamic cable system in conjunction with a special harness, lanyard and pulley assembly combination to allow the user to completely traverse between a series of platforms in a safe fashion and at a desired velocity.

The present invention combines elements of hiking, scenic walking and rock-climbing. In one embodiment, platforms are created in trees from which individuals can depart and arrive. In a particular embodiment, a series of platforms are mounted about or onto trees. Cables are then used to interconnect these tree/platform stations to create a travel path along a cable such that a traveler can connect to the cable and traverse from tree to tree. Travelers use particular equipment, such as harnesses, lanyards, pulleys, belays systems, carabiners, locks, and/or ropes to connect themselves safely to the cable so that they can traverse the distance between the trees/platform stations. The process of traveling/traversing continues until the traveler reaches the end of the path of interconnected cables and platforms.

In one embodiment, fixed height cables are employed that are fixed in position and that are not adapted for adjustable vertical movement in relation to a platform support structure. The velocity by which individuals travel along such a suspended cable is controlled by factors such as the weight of the traveler, wind conditions, tension of the cable, angle of descent, type of cable, type of pulley system, frictional coefficients, type of harness utilized, etc. For example, a person weighing 250 pounds may have increased velocity compared to a person weighing 100 pounds. In a preferred embodiment, however, the weight of a rider (as long as the rider weighs more than 50 lbs. and less than about 400 lbs.) makes little difference. While not bound by theory, this is believed to be due to the relatively small effect the rider's weight has on the coefficients of friction involved in the pulley/cable contact (as discussed herein). In another example, if the angle of descent is sharp, it results in an increase in the velocity of the traveler. In a preferred embodiment of the invention, the trajectory descent is calculated in order that any traveler can travel at a desired velocity to the next tree/platform station and arrive at a velocity substantially similar to the velocity of another rider weighing either 50 lbs. more or less. Preferably, the desired velocity will be generated by the force of gravity and will be a velocity whereby the traveler can coast to a stop or to a very low speed (e.g., less than about 1 mph) at the next arrival tree/platform station. Notwithstanding the preferred embodiments, additional embodiments of the invention can take advantage of the use of accelerator or braking devices to increase or decrease the velocity of travel.

In another embodiment of the present invention, a dynamic cable system is employed. Such a dynamic cable system allows the adjustment of the tension of a cable and/or the angle of cable descent, preferably by vertical adjustment of one or both of the heights of the ends of the cable at connection points existing at particular support structures. The height and tension of the cables can be adjusted to adapt to various conditions presented, such as the weight or bulk of the traveler, wind conditions, type of harness used, and/or to achieve a desired rate of travel speed along the cable. In order to ensure that an individual is able to descend on the cable at a desired velocity and to completely reach the other tree/platform station at a desired arriving velocity, a certain elevation of the cable should be maintained with respect to the second connecting tree/platform station (e.g., arrival platform) as compared to the departure platform. A certain drop in elevation, as well as a certain amount of slack or "swag" in the cable, provides for enough velocity so that the traveler can traverse along the entire spanned distance of the cable in a safe and desired manner. Thus, in one embodiment, adjustable cable means are employed to address various conveyance concerns.

It has been found that the success of traversing a distance between tree/platform stations can be greatly influenced by the various environmental and mechanical factors as mentioned above. If one ignores such factors, one result may be that one or more factors (e.g., wind resistance, weather conditions, etc.) will inhibit a traveler from being able to traverse the entire distance between the tree/platform stations. Conversely, too much velocity may be another by-product of an improperly adjusted fixed height cable system. In such situation a traveler is in danger of moving too swiftly into a fixed platform or structure. Although not necessary when preferred embodiments are employed, to limit any physical injury to a rider, station platforms can be adequately padded and/or cushioned to absorb the impact of a traveler when approaching the next tree/platform station.

As stated above, one aspect of the present invention is directed to the ability to adjust the cable height along at least one of the support structures. In one embodiment, such adjustment of the cable height is achieved by moving just one end of the cable, either upwardly or downwardly, in a vertical direction. In other embodiments, both ends of the cable can be moved with respect to each other to adjust the height of the end points of the cable to a desired level. A variety of mechanisms can be utilized to achieve the adjustment of the cable height. One of such mechanisms is illustrated in FIG. 8. Other means for adjusting the height, however, include a geared or chain operated mechanism (not shown) that will be known by those of skill in the art with this teaching and guidance.

In certain embodiments, the cable height can be adjusted even during an individual's conveyance on the cable. For example, the cable height can be adjusted at one or both ends (e.g., between two adjacent platform supports) before and/or during the "flight" of an individual along the cable in order to establish certain desired velocities during the flight, to overcome wind resistance, to facilitate the use of different harnesses, cables and/or pulley combinations, or any of the above. In certain embodiments, wireless sensors can be utilized to gauge the proper velocity of a person traversing the cable in order to ensure desired speeds at the arrival platform. For example, laser reflectors can be provided on the cable pulley mechanism, as well as on one or both cable platforms, to reflect, signal and/or record position and velocity information. Such signals can then be used to adjust desired cable heights and/or designs. Global positioning systems may also be employed alone or in conjunction with such other signaling devices to obtain information useful in adjusting the system.

With respect to the drop in elevation and relative heights of the cable between two platform stations, a preferred ratio of about 0.0365 drop to span distance is used. For example, a 100 feet span between platform stations would require between about a 3 foot to about a 5 foot drop, more preferably at least about a 4.8 foot drop in elevation, and most preferably about a 3.65 foot drop, to achieve a desired velocity. While the distance between tree/platform stations can vary from about 15 to over about 1000 feet, however, a distance between 40 to 500 feet is preferred, and more preferably less than about 400 feet.

Other aspects and embodiments of the present invention entail the identification of a forest of trees that have trees suitable for serving as support structures for arrival/departure platform stations. Preferably a forest having old growth trees with a significant circumference will be used to support the platform stations. Preferably, trees with between a 6 to 10 foot circumferences will be used, or alternatively, trees having diameters of between about 25 to about 40 inches, or about 2 feet to about 4 feet in diameter. Multi-piece platforms can be fitted/constructed around such trees at desired heights, typically at least about 20 feet high off the ground, more preferably, at least about 30 feet, and most preferably, between about 35-50 feet. Circular or polygonal shaped platforms may be created about the support structures, however, octagonal platform shapes are preferred. The platforms allow for a stopping point between support structures and allows for access to the suspended cables (e.g., to permit them to be adjusted prior to the descent of each traveler, etc.).

The platforms used with the present invention are preferably supported at a desired height by the use of a plurality of cable blocks employing a plurality of holes through which cables are positioned and tightened about the support structure. Such stricture devices preferably have holes to accommodate cables that run through and encircle the support structure, e.g., tree. The cable blocks protect tree bark from significant damage due to the constricted cables. Preferably, cable blocks having three stacked apertures are used for each stricture device (see FIG. 3).

Another aspect of the present invention relates to various suitable harnesses that may be employed to safely transport individuals between platform stations. To avoid the danger of high speed travel and to minimize dangerous angles of impact, a traveler may be suspended from a cable in a sitting or semi-standing position in his or her safety harness. In one embodiment, a harness is employed that permits a traveler to hang suspended in a prone position, thus permitting an individual to have a near bird-like "soaring" experience when being transported between platforms. Various body orientations can be facilitated to accommodate paralyzed individuals (e.g., wheel-chair bound) so that such individuals may experience an exhilarating feeling of "flight" using the present system.

In certain embodiments of the invention, specialized harness devices are employed. In one preferred embodiment, a harness is employed that permits the traveler to substantially sit in a descending position from the cable while in transit. Shoulder, waist, and individual leg openings are provided to ensure a safe and secure harness (see e.g., FIG. 6). Carabiner campons that require a double action to open are preferably used for safety purposes (e.g., to avoid accidental openings). In yet another embodiment of the invention, a harness device is used where the traveler can be in a prone or recumbent and/or reclined position, either facing down, up and/or sideways. When the traveler traverses the cable in certain positions, it gives the feeling of flying or "soaring" in the air as the traveler traverses from platform station to platform station. In another embodiment of the invention, a harness device is used that allows for the traveler to traverse the distance between tree/platform stations in an upside-down sitting position. Such additional optional orientations and degrees of physical movement during "flight", may add considerably to the "soaring" experience.

Certain embodiments of the present invention utilize a pulley mechanism that traverses a cable, such pulley mechanism preferably being encased either partially or entirely by a housing. The housing not only is capable of protecting the pulley mechanism's contact with the cable from undesired exterior environmental forces, such as weather, a user's undesired touching of the pulley mechanism, etc., but also protects the pulley mechanism from damage either during use or non-use (storage) of the mechanism.

Another aspect of the present invention is directed to the overall "soaring" system and method, preferably utilizing existing living trees as the vertical supports for individual platforms. A plurality of tree stabilized platforms are used, preferably at least three individual tree platforms, more preferably at least about five platforms, and most preferably, at least about seven or more tree platforms. While any desired orientation of a cable linkage between such tree platforms can be accommodated, preferably the tree platforms are not connected together in a substantially straight line. For example, it is desirable to have the placement of adjacent cable connected platforms such that the angle between any two adjacent cable lines varies by at least about 10°, more preferably at least about 30°, and most preferably by at least about 45°.

In one embodiment of the invention, particular platform construction and associated cable attachments involve the arrangement of preformed metallic, preferably non-rusting metal (e.g., stainless steel) or plastic and/or composite material, in a generally circular and/or polygonal orientation about a support, such as a living tree trunk. The outermost portion of such segments (as determined from a distance from the tree trunk) are preferably operatively associated with one or more cables (although other attachment methods and systems can also be employed). Such cables extend to at least one, and preferably at least two, separate support encircling devices positioned well above the platform. For example, as illustrated in FIG. 3, at least one tree encircling cable apparatus (e.g., tree stricture device) is provided at a desired height above a tree encircling platform. While the distance of such a tree hugging, cable support apparatus above any given platform can vary, preferably such distances are selected so as to provide adequate room for individuals to walk entirely around the tree platform (e.g., under the suspending cables). Similarly, for safety and stability reasons, additional cable hugging support apparatuses can be positioned even further up into a supporting structure and/or tree to provide yet an additional cable support for the platform.

Another aspect of the present invention is directed to a conveyance system between living trees in a manner that preserves the health and life of such trees. Cables wrapped directly around the bark of a tree may cause damage to the trees. Cables are therefore preferably not affixed directly to a tree or wrapped around the tree in such a manner as may cause the surface of the tree to be significantly damaged when tension is applied by encircling cables. The cable hugging support apparatuses used in conjunction with the present method and system are preferably constructed using at least two, and preferably at least three, encircling cables. It should be understood that a single cable is preferably wrapped around the tree at least two, and preferably at least three times, with cable blocks being provided, preferably with apertures and/or groves formed therein, to accommodate the desired number of cables being wrapped around the supporting vertical structure and/or tree. The blocks, preferably made of oak wood, protect the tree bark surface by preventing damaging contact between cables and the tree surface.

Cables connecting adjacent tree supported platforms can be attached to the tree hugging support apparatuses in any desired manner, preferably by being operatively connected to at least one of the three encircling cables, and most preferably at least by connecting to the second of at least three cables encircling a tree structure. (See FIG. 3).

In particular embodiments of the present invention, largely ornamental features are provided that descend from the platform and/or tree supported platforms. Such ornamental features can include, for example, tapered ornamental lengths of metal, thereby providing a visually attractive appearance to the structure. In some embodiments, for example, the ornamental designs can provide a Lord of the Rings' appearance, suggesting an affiliation with the tree-loving author of such literary works.

One embodiment of the present invention is directed to a system for transporting a rider between a plurality of platforms. A series of support structures is spaced at least 50 feet apart and a plurality of upper cable supports and lower cable supports is provided on such support structures. The lower cable supports are located at a predetermined lower elevation than the upper cable supports to provide for a generally declining aspect of a cable strung between such supports. A cable extending between the upper and lower cable supports will have a nadir that is at a lower elevation than any two adjacent upper and lower cable supports. The cable is provided with a predetermined swag that is selected to ensure that a rider traveling along the cable arrives at each of a plurality of platforms at a velocity of at least 0.25 mph and less than about 3 mph.

A plurality of platforms is adapted to be operatively associated with the various support structures, such as trees. The platforms are preferably suspended from the structures by a plurality of cables, with the platforms having an area sufficient to accommodate at least four adults in a standing position.

In a preferred embodiment, the system employs a debarkation stand that is elevated above one of the tree supported platforms. The elevated stand permits a rider to properly position themselves and connect themselves to the suspended cable, prior to departure.

Although a variety of pulley assemblies can be utilized, a preferred assembly includes at least two separate pulleys for rollingly contacting a cable that is at least about ¼ inch in diameter, and more preferably at least about ½ inch in diameter. A pulley assembly preferably also includes a safety cable or other suitable means for preventing accidental disengagement of a suspended rider from the cable during transit. A pulley assembly is used that is preferably reversibly mountable on the suspended cable for movement there along. The pulley assembly is operatively associated with a single lanyard, such lanyard connectable to a rider's harness. The rider's harness is adapted to connect with either the pulley assembly itself or with the lanyard, and is designed to support at least one rider for travel along the suspended cable. In some embodiments, a brake means can be employed for controlling the rate of descent of any pulley assembly during travel along the cable.

In a preferred embodiment of the present invention, a plurality of trees act as the support structure for the cable suspension structures. The tensioned riding cable between such trees has a predetermined series of swags such that the nadir of the cable formed between any two trees is lower than the adjacent support assemblies.

An angle formed by a line connecting the uppermost portions of a cable connected to two adjacent structures, as compared to the said nadir of the cable, is preferably no more than 170°, is more preferably less than 120°, and is most preferably at least about 90°.

In certain embodiments, determining means for gauging wind or other frictional forces can be employed to properly adjust the suspended cable, thus ensuring a safe departure and arrival velocity of a rider.

In one embodiment, more than one suspended cable runs between adjacent supporting structures, such as trees. This facilitates the parallel enjoyment of a "soaring" experience by relatives and friends, rather than merely having an individual rider depart and arrive on adjacent platforms in series. Preferably, support structures, such as trees, are either created or selected to be at least 50 feet apart and platforms in such structures are elevated at least about 20 feet, more preferably, about 30 feet, and most preferably, between about 25 and 50 feet off the ground. The platforms are preferably constructed of stainless steel and suspended from individual trees by a plurality of cables connected to tree collar devices positioned at least 10 feet above, more preferably at least 15 feet above, and most preferably, at least 18 feet above each of the platforms. The platform area is sufficient to accommodate several adults in a standing position. Cable support structures are positioned so that, when such trees are about 100 feet apart, there is a vertical drop of at least about 3 feet between two cable connection points on adjacent trees. This approximate same ratio can be employed regardless of how far away two adjacent structures are positioned.

This summary of the invention is not intended to fully describe each and every potentially important aspect of the present invention. One of skill in the art will understand from the entire specification, including the drawings, claims, detailed description, etc., the full scope of the present invention. As one skilled in the art will appreciate, other objectives, advantages and characteristics of the present invention will become apparent in the following detailed description of the invention and associated figures and claims.

DETAILED DESCRIPTION OF PREFERRED EMBODIMENTS OF THE PRESENT INVENTION

Figure 1:
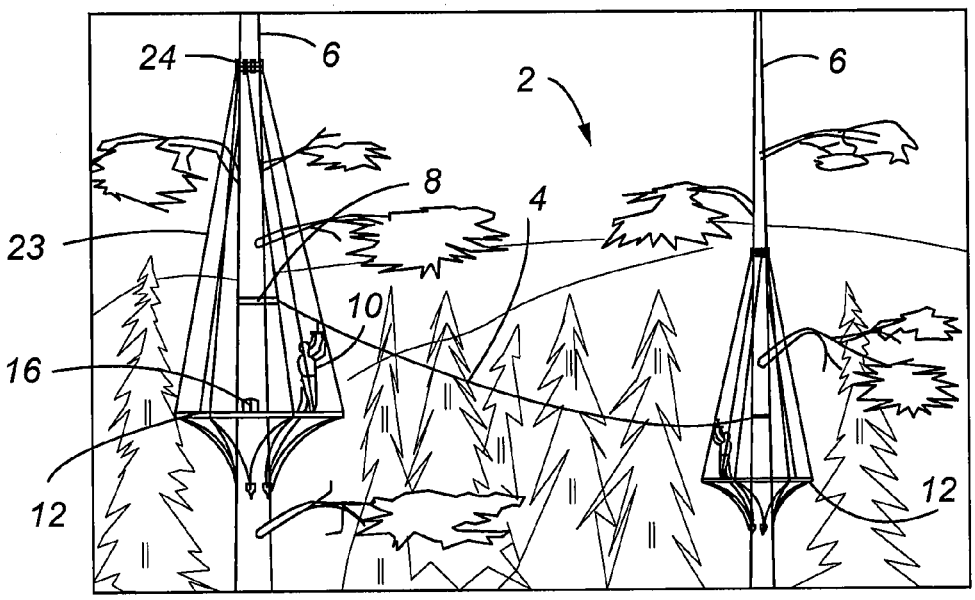
FIG. 1 is a perspective view of two tree platform towers in a series of such towers.
Figure 2:
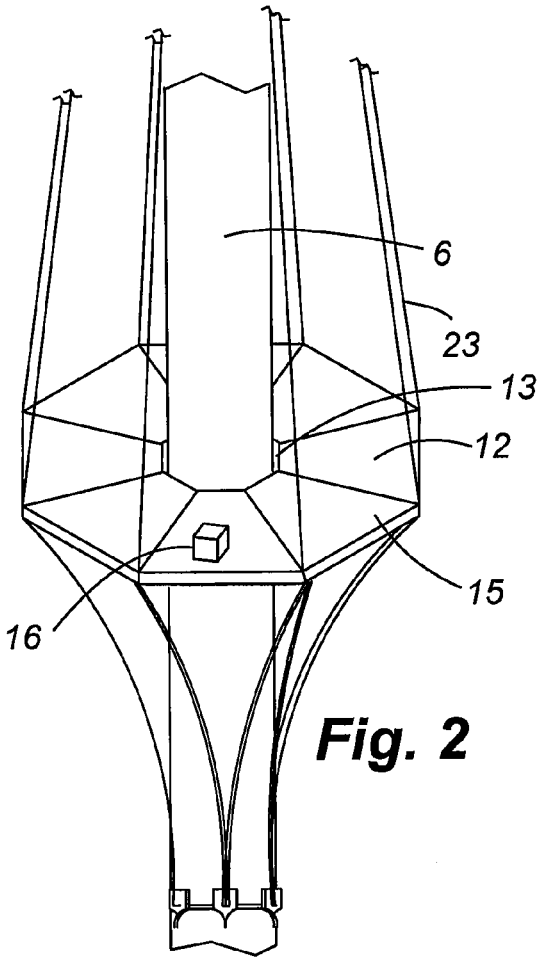
FIG. 2 is a partial perspective view of a platform encircling a support structure with suspension cables supporting such platform and ornamental design features descending therefrom.
Figure 3:
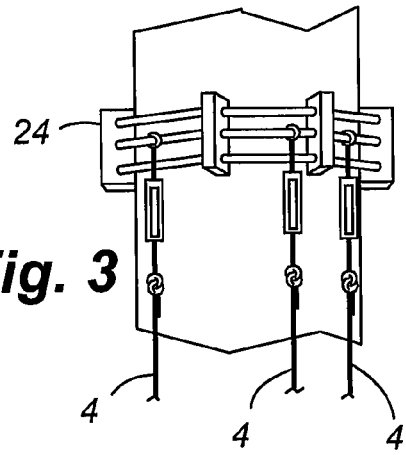
FIG. 3 is a perspective view of one support encompassing cable/block system for connecting suspension cables to a support structure such as a tree.
Figure 4:
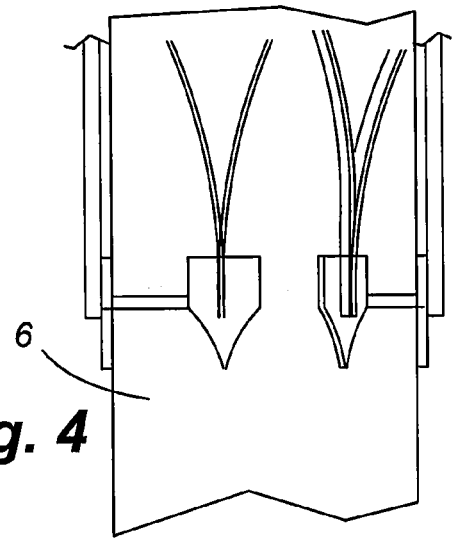
FIG. 4 is a partial perspective view of certain ornamental features of one particular embodiment of the present invention, namely descending structures from a platform.
Figure 5:
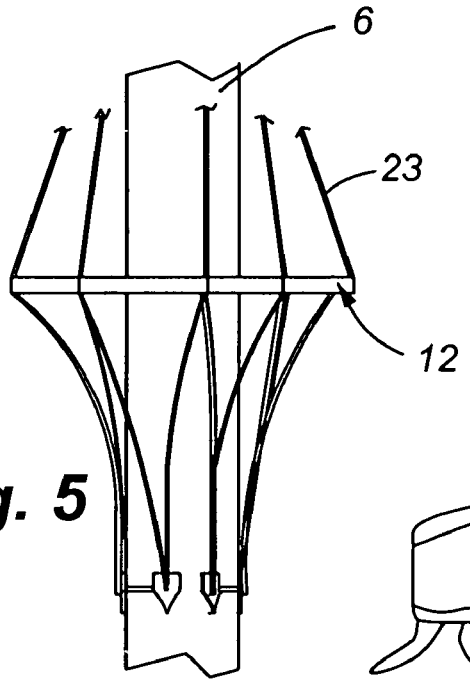
FIG. 5 is a perspective view showing a platform suspended from cables with ornamental features descending below.

In one embodiment, the present invention comprises a series of cables 4 suspended from between elevated supports 6 and/or towers, such supports preferably being living trees. The type of supports 6 can therefore vary, but are preferably living trees of suitable size. Suitable tree sizes will be those trees having a trunk at least about as large as a telephone pole, preferably at least about 8 inches in diameter, more preferably at least about 12 inches in diameter, even more preferably at least about 20 inches in diameter, and most preferably, in excess of at least about 30 inches in diameter tree trunks, as measured near the ground surface of the tree.

Alternatively, various types of support structures can be utilized that will be understood by one of skill in the art. For example, towers fabricated from either metal, stone, plastic or wood can be constructed to desired heights and dimensions in order to suspend the cable 4 between such artificial support structures, or between artificial support structures and living tree structures, rock outcroppings, etc. In a preferred embodiment of the present invention, a plurality of tree supporting structures are provided such that more than one span of cable 4 is employed in any given system. Preferably, at least two, more preferably at least three, and most preferably between about five and about ten separate cable 4 suspension lengths are employed in the present system. There is no limit to the number of supports 6, utilized however, other than the elevation difference between the first and the last of such supports 6. In a preferred embodiment, such cable 4 spans are not designed so that a rider of the cable system 2 is trajected in a substantially straight line over two adjacent cable lengths. For example, the angular orientation of one cable 4 length with respect to another will preferably vary such that the rider 10 of the system 2 will be redirected in an angular fashion along the system. Preferably, such angles are from 10° to 170°; more preferably at least about 20°; and even more preferably at least about 30°.

In one particular embodiment of the present invention, a rider 10 may not necessarily disembark after traversing a particular cable 4 length, but rather may simply have had his/her speed reduced to a desired speed when the rider 10 approaches a platform 12 and/or supporting structure 6, only to then substantially immediately descend yet another cable 4 suspension length. In such manner, a rider 10 can "soar" between two platforms 12 on a suspended cable 4, traverse a short length of cable 4 juxtapositioned near a second platform/structure, and have momentum remaining to proceed onto yet another cable 4 length. Such series of sinusoidal connections, with the apex of each top-most curve of a cable 4 demarking a position at or near a support 6, preferably at a standing platform 12, facilitates a free flowing conveyance of a person through various high to low altitudes and/or elevations.

In other embodiments of the present method, however, an individual is disassociated from the suspended travel cable 4 after reaching/arriving at each platform 12. When a rider 10 arrives at a debarkation platform 12, he/she is then disconnected from a first traversing cable length and then connected to a separate second traversing cable length, prior to departing from such cable platform 12 on the second cable length. In other words, in one embodiment, a rider 10 enjoys a brief respite between each traversal of a particular cable length. In such a manner, the present system provides for an enjoyable group and/or family experience. Children, parents and grandparents can all sequentially traverse particular cable lengths, and join each other in a group on a second departation platform 12, thus being able to share the thrill of their immediate experiences with each other as they are experiencing the departure and arrival of each respective person.

Any suitable pulley 14 and/or trolley system can be utilized, however, preferred pulley systems are obtained from Petzl America, Freeport Center M-7, PO Box 160447, Clearfield, Utah 84016, USA. In a preferred embodiment, a double pulley apparatus 14 is utilized to ensure suitable contact with a suspended cable 4. Suitable pulley assemblies can be fabricated from components made of stainless steel, high density plastic, composite materials, etc. When properly placed in operative association with a suspended cable 4, a suitable pulley/trolley mechanism 14 employs a groove which corresponds to the outer dimensions of the suspended cable 4.

In order to attach the pulley/trolley 14 to the suspended cable 4, a lanyard associated with a particular harness 18 worn by a rider 10 can be connected with the pulley system 14, and the pulley system 14 is then manually placed into operative engagement with the suspended travel cable 4. In a preferred embodiment, an additional safety cable 4 is employed so that in the unlikely event that the pulley 14 disengages from the suspended cable 4, the rider 10 is still suspended from the cable 4 by means of such safety cable.

Although the above-mentioned cable 4 assembly is preferably utilized with the present invention, other "zip line" cable or trolley apparatuses (or variations thereof) may be used. For example, the trolleys described in Richardson, U.S. Pat. No. 6,666,773; Clyvick, U.S. Pat. No. 6,622,634; McEwen, U.S. Pat. No. 3,040,678; Remington, U.S. Pat. No. 5,224,425 and Davis, U.S. Pat. No. 4,062,293 may be employed. One of skill in the art will appreciate that such prior art trolley systems may need to be modified to work cooperatively with the particular harness systems as hereinafter described. Preferably, a suitable pulley assembly does not employ any type of T-bar device that is grasped by a rider 10 in a region near the suspended travel cable 4. As such, the present invention avoids the prospect of a rider 10 injuring his/her hands by contact with a pulley mechanism and/or cable 4.

Figure 6:
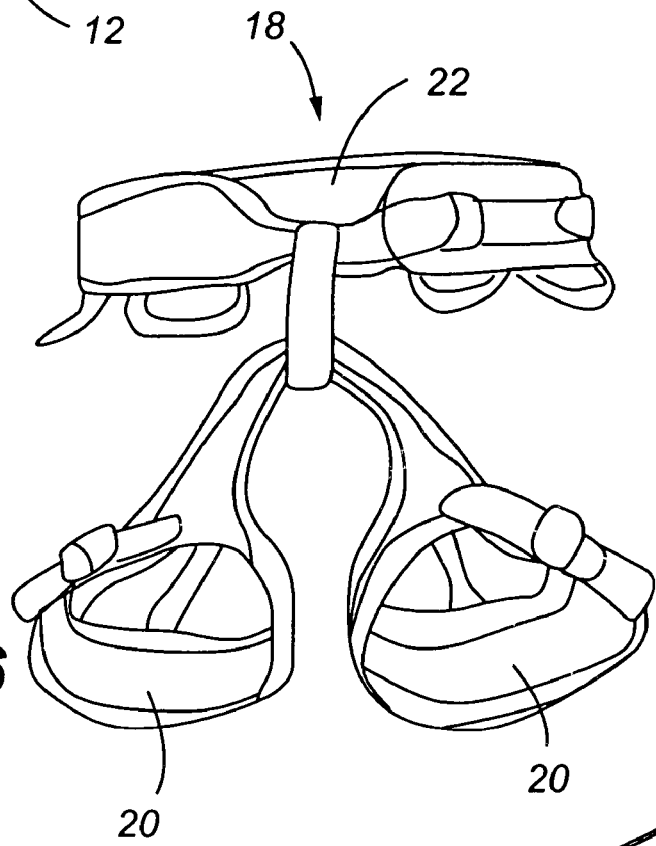
FIG. 6 is a perspective view of one embodiment of a harness that can be worn by a person in using the system.
Figure 7:
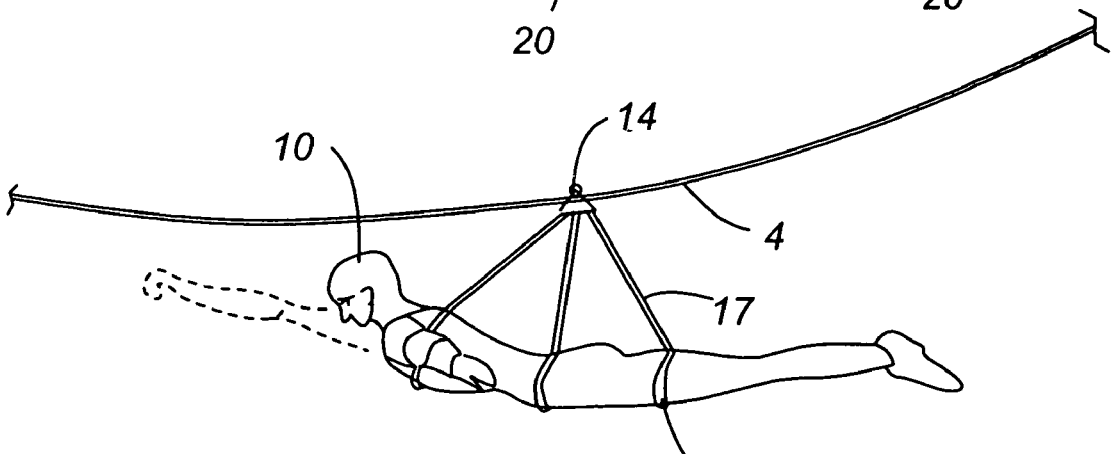
FIG. 7 is a perspective view of a person in one type of "soaring" harness being conveyed along a suspended cable.

One embodiment of a harness system 18 is depicted in FIG. 6 and is available from Petzl Company. Preferably, a suitable harness 18 employs a pair of leg encircling harness members 20 that are operatively associated with a back and/or butt supporting pad 22. The harness 18 is connected to at least one lanyard that preferably extends in front of a person's chest, such that when the person is suspended from a cable 4, the person is essentially in a substantially seated position. In one embodiment, the rider 10 can grasp the lanyard with his or her hands during the ride. Preferably, the lanyard is of a length such that a rider 10 is incapable of reaching the traveling cable 4 with his/her hand. Moreover, a pulley system is directly connected to such lanyard so that a person walks to a debarkation platform 12 with all necessary gear to enjoy the system.

In an alternative embodiment, a harness 18 system is employed that provides for the person to adopt a more or less "bird-like" body orientation. Such a harness 18 system involves a cable connecting device, such as a lanyard, that connects to a harness 18 in the rear or back (along the spine) portion of a rider 10. In a preferred embodiment, such harness system 18 can be obtained from Petzl Company. While various harness 18 designs can be employed, one such design provides for a "taco-like" and/or "cocoon" configuration such that a person's front portion from about below their neck to at least their waist region, and more preferably even descending to about their thighs, encircles the front most portion of their body and is gathered in the back of the person. A connecting means is located at the back most portion of such harness 18, with the connecting means associated with the pulley and/or trolley 14, which is connectable to the suspended cable 4.

While in a preferred embodiment a pulley assembly 14 is associated with any suitable harness 18, it is within the scope of the present invention to have pulley systems 14 associated with the suspended cable 4 and that can be operatively reversibly associated or connected with lanyards, which are designed to be connected to a person's harness 18. In use, the taco-like/cocoon-like harness 18 can be employed so that a person can literally leap off a platform 12 beneath a suspended cable 4, and traverse the suspended cable 4 length in a flying position with arms either being outstretched or collapsed by the rider's 10 side.

In other embodiments, the connection between the pulley 14 and a harness 18 is adapted to facilitate rotation, spinning or other desired movement of a rider 10 when conveyed along the suspended cable 4. For example, the lanyard can be of sufficient length so that a rider 10 may invert themselves to convey themselves head downward along the suspended cable ride 2 while still being safely suspended.

With respect to the arrival and departure platforms 12 utilized with the present invention, in a preferred embodiment such platforms 12 are constructed so as to encircle suitable towers and/or supports 6, most preferably living trees. Such platforms may comprise a series of pie-shaped members 15 placed side-by-side and connected to each other, as well as being connected to the tree by means of suspension cables 23 extending from the outer edges of such platforms 12 to fixed cable connection supports 24 positioned at least about 8 feet above such platforms 12. The manner in which the platforms 12 are associated with tree-support structures in particular, provides a "tree friendly" connection that does not harm the tree and which facilitates and accommodates tree growth without replacement or adjustment of the suspended platform system 12.

In a preferred embodiment, the supported platform structure 12 of the present invention can be prefabricated and easily installed on tree trunks having different diameters within a specified range. The platforms 12 are designed and suspended so that they can safely bear substantial loads for protracted periods of time. For example, the platforms 12 are designed to accommodate and facilitate the weight of several individuals, preferably at least three adults weighing at least 125 lbs, more preferably at least five of such adults, and most preferably, at least about 8 of such adults. With the ability to have prefabricated pie-shaped members 15 manufactured, it is possible to construct desired tree platforms 12 and erect the same quickly and with a minimum of on site fabrication, construction and labor.

In certain embodiments, the platforms 12 may also be used in conjunction with a protective or decorative roof-type structure extending over the platform(s). Moreover, walls or restraining structures extending between the roof-like structure and platform 12 can be provided for. Platforms 12 similar to that described by Jarmin, U.S. Pat. No. 5,522,186, can be employed in conjunction with certain embodiments of the present invention, such patent incorporated herein in its entirety by this reference to provide additional description of how such structures can be constructed and employed. Preferably, however, the platforms 12 do not comprise any wall or side structures, adding to the open space feeling of the "soaring" experience. In a preferred embodiment, predesigned pie-shaped members 15 are assembled to form a platform 12 that encircles most, and preferably all, of any given supports 6. When the support is a living tree, small spaces 13 between the portion of the platform 12 (closest to the tree) are purposefully created, thus facilitating room for squirrels and other tree dwelling creatures to climb up and down the tree.

In a preferred embodiment, each support structure 6 preferably employs a single ground contacting edifice, such as a single tree. In other embodiments, however, platforms 12 can be constructed between a cluster of relatively closely spaced trees, trees adjacent rock structures, and combinations thereof, etc.

Figure 10:
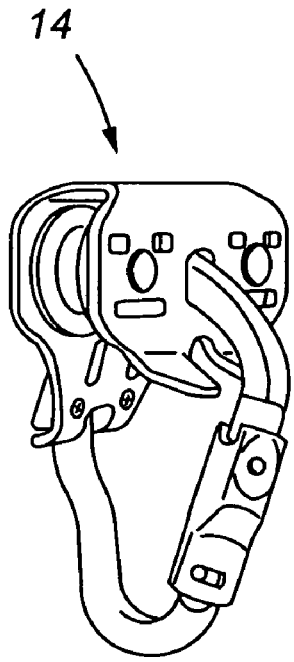
FIG. 10 is one embodiment of a double pulley cable riding mechanism with a preferred lanyard connecting automatic locking system with visual indicator for closure

With respect to a suitable pulley assembly 14 for use in the system, for example referring to FIG. 10, a pulley 14 is preferably designed to readily engage and disengage the cable 4 under desired conditions, for instance, when a rider 10 arrives at and/or departs from each platform 12 in a series of platforms 12. The pulley 14 is constructed preferably from stainless steel to avoid any undesired rust or other weather abrasion. The rotating pulley members can be fabricated from stainless steel, or other durable plastic, composite, Teflon, high density polyethylene, etc., and such pulleys 14 will have suitable longitudinal grooves formed therein to accommodate the suspended traveling cable 4. Preferably, a pulley assembly 14 employs one or more pulleys 14 that contact a suspended traveling cable 4 only on the upper-most portion of such cable 4. In other embodiments, however, other pulley systems 14 can be employed where pulley members contact both the top as well as the bottom and/or sides of a suspended cable 4.

In certain embodiments of the present invention, braking assemblies can be used in conjunction with the pulley assembly 14, such as those disclosed in, for example, the Richardson '773 patent. Such braking systems are incorporated by reference herein. Preferably, however, no braking systems are utilized either as part of the pulley assembly 14 or as part of the suspended traveling cable 4. Rather, the proper elevation of the cable ends and appropriate swag of such cable 4, provides a rider 10 with a journey that results in an arrival speed sufficient to have the rider 10 end up safely on a platform 12. Preferably, a rider 10 arrives at a platform 12 moving less than about 3 mph, more preferably less than 2 mph, and most preferably, less than 1 mph.

Preferably, a single suspended cable 4 is utilized between adjacent platforms 12. In other embodiments, however, more than one cable 4 is suspended between such platforms 12 so as to facilitate the ability of more than one person to traverse between such platforms 12 at any given time. For example, such an embodiment facilitates a father and a son both departing a platform 12 at substantially the same time, traversing parallel aligned cables and arriving at an adjacent arrival platform 12 in tandem.

Platforms 12 formed around support structures preferably include a broad enough decking area so that an operator can facilitate the mounting and dismounting of riders 10. Again, in a preferred embodiment, a plurality of riders 10 can arrive and/or depart from any particular platform, preferably at least about four riders 10, plus an operator.

In certain embodiments, an elevated portion is provided on the platform to facilitate the engagement of pulley assemblies to a suspended traveling cable. For example, a milk-box sized elevated structure 16 can be provided to permit a rider to step up onto so that he/she can have their pulley and/or lanyard operatively associated with the traveling cable. The rider can then step off of such elevated portion to begin traveling forward on the cable.

In alternative embodiments of the present invention, certain types of shock absorbing devices can be utilized to impede or otherwise slow the progress of a rider 10 on the cable system 2. In preferred embodiments, such dampening and/or shock absorbing systems are not desired, it being a general objective to rely upon gravitational force and proper vertical adjustment of end portion cable 4 heights to facilitate a safe and enjoyable conveyance from one platform 12 to another. In certain embodiments, however, such shock absorbing or dampening devices maybe employed. Such devices are described, for example, in Cylvick, U.S. Pat. No. 6,622,634, which is hereby incorporated by this reference.

In a preferred embodiment, the harness 18 system employed utilizes a single lanyard, rather than more than one lanyard. In other embodiments, however, two or more lanyards 17 can be employed, associated with conventional climbing harnesses. Additional cable connecting lanyards can be employed as safety devices in the event a cable pulley 14 malfunctions and/or disengages from the cable 4 itself. In a preferred embodiment, however, additional lanyards are not employed for such purpose, but rather, a separate smaller safety cable (not shown) is employed that ensures that the pulley/trolley cannot become disassociated with the suspended cable 4.

Although the present system is adapted primarily for daytime use, such system can also be employed at night. The thrill of soaring through nighttime air between tree supported platforms 12 is exhilarating, and artificial illumination may also be employed to highlight various features of the terrain above or below the suspended cable 4. Riders 10 can be outfitted with earphones to have recorded music or environmental information provided to further enhance their "soaring" experience.

The present system can be adapted for use in existing resorts where changes of elevation can be employed advantageously to construct and employ the system. Ski resorts are an obvious ready-made facility that can readily transport riders 10 to a heightened elevation to initiate "soaring" along suspended cables 4. The use of existing large trees and/or other natural structures that exist in a majority of ski areas also provides a ready environment to employ the present system and method. The present invention can be utilized in both summer and winter months. In winter months, suitable adjustments to pulley/trolley systems can be employed to facilitate the removal of snow and/or ice from cables 4 and riders 10 can either dress in appropriate warm clothing and/or the harness 18 system utilized can be appropriately insulated and/or heated for such purpose.

In a preferred embodiment, a rider 10 rides outwardly and downwardly after departing a platform 12, reaches a low point on the suspended cable 4, and continues up the incline portion of the cable 4, relying on natural friction and gravitational forces to limit the speed of the rider 10 at the point at which he/she arrives at the destination platform 12. Operators on platforms 12 can audibly communicate with other platforms 12 to ensure that it is safe for a next rider 10 to descend.

Unlike certain prior art systems that rely upon a rider's 10 ability to brake a cable pulley system 14 effectively to adjust the rider's 10 speed, the present system preferably is designed so that a rider 10 departs comfortably from one platform 12 and arrives at the other platform 12 without any worry that they will reach the other platform, or conversely, will reach the other platform 12 at too great a velocity. In certain prior art systems, riders 10 have the ability (if not the necessity) to brake their velocity early on, which may cause the rider 10 to be deprived of sufficient speed to complete the cable 4 extension. In other words, in a preferred embodiment, the present invention does not rely upon the rider 10 to gauge his/her own speed, but rather the system is designed so that all riders 10 will safely and effectively be transported from one platform 12 to the other based upon the system's predetermined design and orientation. Indeed, in certain prior art systems of "cable skydiving", riders are encouraged to get off at a cable's 4 nadir and depart from the cable 4. In the present system, however, such disengagement from the cable 4 at any point other than at an arrival and/or departure platform 12 is discouraged and/or made impossible.

The swag of a cable 4 between two supporting structures 6 can be determined by the cable length, the distance between the support structures 6 and the heights of such support structures 6 The degree of swag is preferably predetermined to account for the respective heights of cable connection points between two adjacent supports. Too severe of a swag in the cable 4 results in the inability of a rider 10 to reach a destination platform 12. Insufficient swag in a cable 4 results in a rider 10 achieving too great a velocity at an arriving/destination platform. One aspect of the present invention is the determination of a desirable cable swag. To a large extent, dependent upon the support structures 6 utilized, the particular cable and/or pulley mechanisms 14, as well as what particular types of harnesses 18 are utilized (e.g., how much wind resistance may be encountered, etc.) the degree of swag in a cable 4 will be empirically arrived at with the governing principle being a safe and effective conveyance of a person from a starting platform 12 to an arrival platform 12 at an appropriate speed. At least some slackness in the cable 4 however, is preferably provided for so as to permit the initial increase in velocity of a person along the initial part of a cable, with a corresponding decrease in velocity at the end of the cable. In some situations, the lowest point of the cable slackness will occur in about the middle of the cable 4 (as measured between the two support structures). In other embodiments, however, the lowest point of the cable 4 will occur substantially between the mid-point of the spanned distance and the arrival platform. To properly determine the degree of swag of the cable 4, a person or other weighted construct can be conveyed down a cable length and the ends of that respective cable can be adjusted to provide the appropriate slackness of the cable 4 to achieve the above-referenced objectives.

Figure 8:
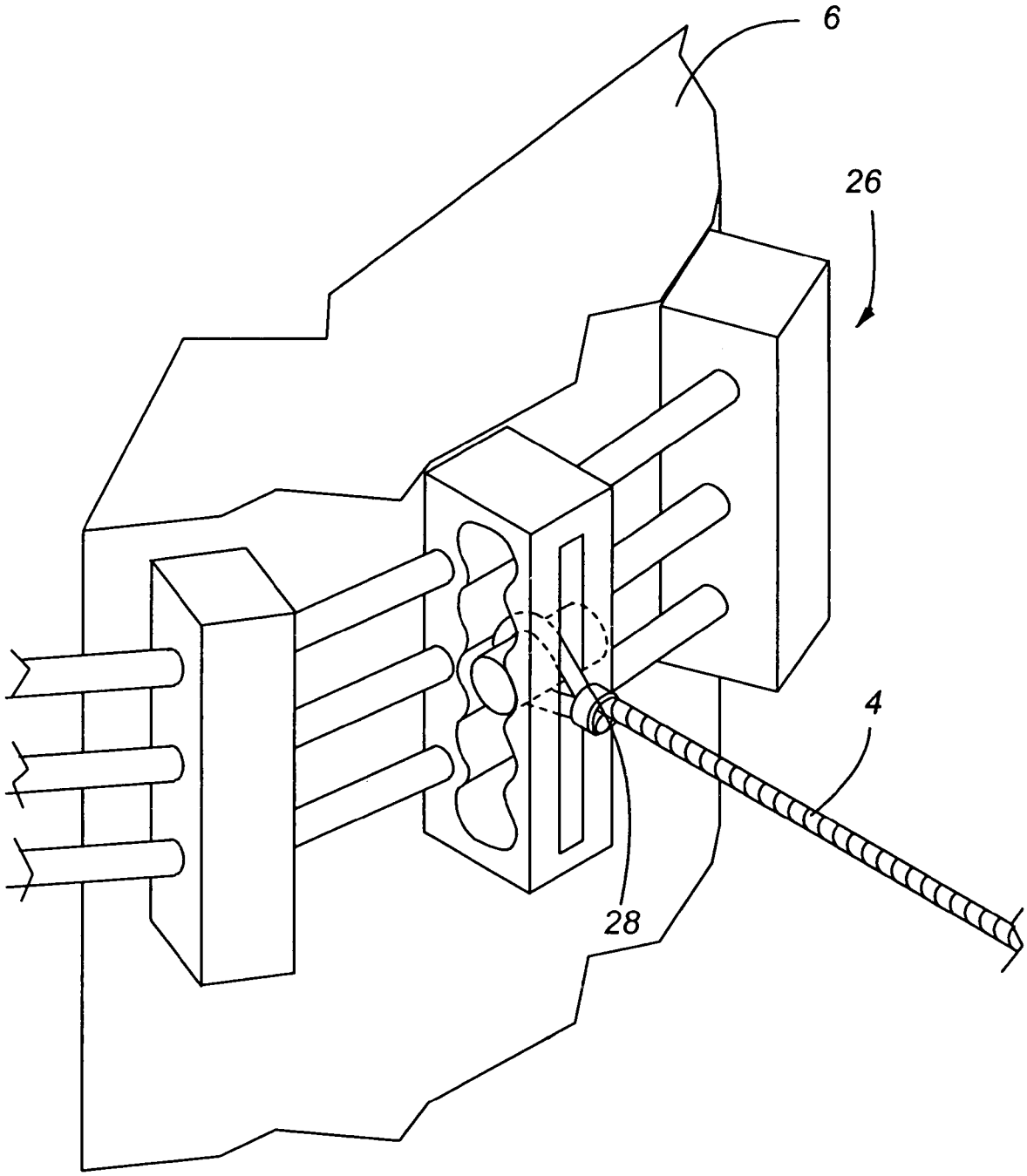
FIG. 8 is a partial perspective view of an adjustable cable attachment incorporated into a cable encircling support device.
Figure 9:
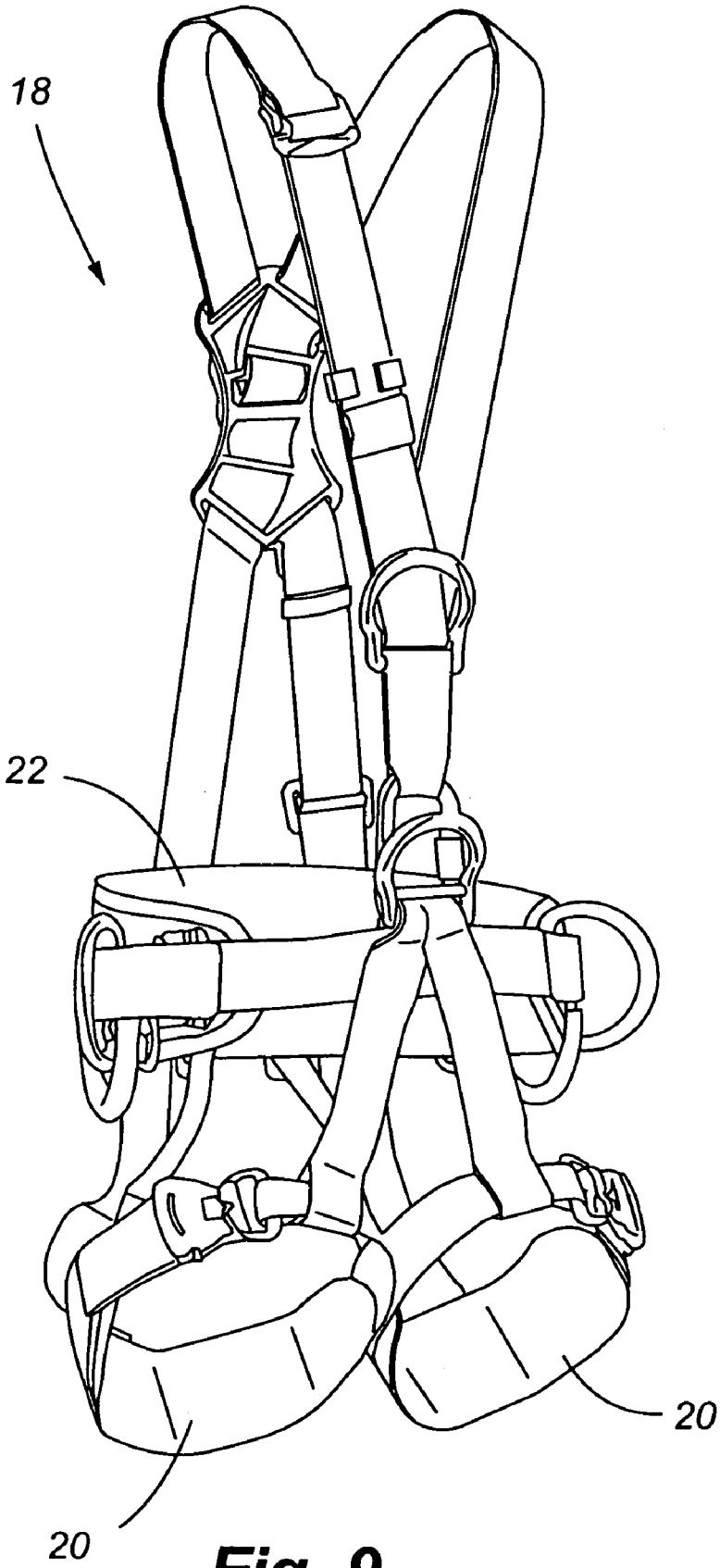
FIG. 9 is a perspective view of one type of harness that can be utilized with the present invention.

Referring now to FIG. 8, another embodiment of the present invention employs a dynamic cable system 26. Such a dynamic cable system 26 allows the adjustment of the tension of the cable 4 and/or the angle of cable descent, preferably by vertical adjustment of one or both of the heights of the ends of the cable 28 at connection points existing at particular support structures 6. The height and tension of the cables 4 can be adjusted to adapt to various conditions presented, such as the weight or bulk of the traveler, wind conditions, type of harness used, and/or to achieve a desired rate of travel speed along the cable 4. In order to ensure that an individual is able to descend on the cable at a desired velocity and to completely reach the other tree/platform station at a desired arriving velocity, a certain elevation of the cable should be maintained with respect to the second connecting tree/platform station (e.g., arrival platform) as compared to the departure platform. A certain drop in elevation, as well as a certain amount of swag in the cable 4, provides for enough velocity so that the traveler can traverse along the entire spanned distance of the cable in a safe and desired manner. Thus, in one embodiment, adjustable cable means are employed to address various conveyance concerns.

Other aspects of the present invention include the use of sound recordings or teachings which can either be communicated to a traveler by sound projecting devices either on platforms 12 or personally carried with a cable traveler. In preferred embodiments, however, there is a desire to have minimal noise interference with the natural sounds of the forest. A more quiet and contemplative environment is desired in most situations. And yet, in other embodiments, thrilling music can accompany a cable 4 travelers journey to add a further enjoyment dimension to the operation. As described hereinafter, a variety of different types of harnesses 18 can be utilized in practicing the present invention. All of such harnesses 18, however, are preferably incredibly safe in operation due largely to at least every important attachment being redundant. Preferably, every piece of hardware, the cable 4 itself, the platform 12 support, etc. are accompanied by at least one additional safety support mechanism and/or device.

With respect to preferred cables 4 for use with the present invention, a non-rotating cable 4 is preferred. For example, in one embodiment of the present invention a 19×7 wrap is used for the cable 4 so as to provide a smooth ride with less noise generation than other types of cable 4 s. In a preferred embodiment, the cable 4 utilized has an inside configuration having counter-clockwise twisted elements with the outside of the cable 4 having clockwise twisted elements. Although in a preferred embodiment, a smooth ride is preferred, in still other embodiments where a rougher ride is particularly desired (e.g., to add to the thrill of the ride, for horrific effect, etc.) other types of cable 4 can be used that provides such a "rougher" ride. For example, in such embodiment, a 7×19 wrap has been found to create a bumpy conveyance.

As described above, it is presently believed that harnesses 18, pulleys 14 and trolleys manufactured by the Petzl company are preferred given their solid construction and safety features.

While various embodiments of the present invention have been described in detail, it will be apparent that further modifications and adaptations of the invention will occur to those skilled in the art. It is to be expressly understood that such modifications and adaptations are within the spirit and scope of the present invention.

What is claimed is:

1. A system for transporting a rider between a plurality of platforms, comprising:

at least three tree support structures spaced at least 50 feet apart;

a plurality of upper cable supports and lower cable supports attached to said at least three tree support structures, said lower cable supports being located at a predetermined lower elevation than said upper cable supports, wherein said upper cable supports comprise a tree encircling device having at least two encircling cables wrapped around a cable block having one of grooves or holes formed therein accommodating said at least two encircling cables;

a cable connected to the cable block at a connecting point in said one of grooves or holes and extending between said plurality of upper and lower cable supports such that a nadir of said cable between any two adjacent ones of said tree support structures is at a lower elevation than any two adjacent ones of said upper and lower cable supports, said cable provided with a predetermined swag that is selected to ensure that a rider traveling along said cable arrives at each of said plurality of platforms at a velocity of at least 0.25 mph and less than about 3 mph, the cable connecting point being vertically adjustable within said one of grooves or holes;

a pulley assembly reversibly mounted on said cable for movement there along, said pulley assembly being operatively associated with a lanyard;

a rider harness connected with said pulley assembly or said lanyard for supporting at least one rider for travel along said cable; and a plurality of platforms adapted for operable association with said tree support structures, said platforms suspended from said tree support structures by a plurality of cables, said platforms encircling said tree support structures and having an area sufficient to accommodate at least four adults in a standing position.

2. The system of claim 1, further comprising brake means for selectively controlling the rate of descent of said pulley assembly during travel along said cable.

3. The system of claim 1, wherein an angle formed by a line connecting an uppermost portion of said cable supports to the said nadir of said cable is less than 170 degrees.

4. The system of claim 1, wherein said harness permits a rider to assume a prone position.

5. The system of claim 1, further comprising a debarkation stand elevated above one of said platforms.

6. The system of claim 1 wherein said cable is constructed of stainless steel and is at least ¼" in diameter.

7. The system of claim 1, wherein said pulley assembly includes at least two separate pulleys for rollingly contacting said cable, with safety means for preventing accidental disengagement from said cable.

8. The system as set forth in claim 1, further comprising one or more additional tensioned riding cables positioned so as to facilitate a rider to glide along said additional cables.

* * * * *